US012447383B2

(12) United States Patent
Isgar

(10) Patent No.: US 12,447,383 B2
(45) Date of Patent: Oct. 21, 2025

(54) SMART GOLF BAG SYSTEM

(71) Applicant: Charles Isgar, Scottsdale, AZ (US)

(72) Inventor: Charles Isgar, Scottsdale, AZ (US)

( * ) Notice: Subject to any disclaimer, the term of this patent is extended or adjusted under 35 U.S.C. 154(b) by 801 days.

(21) Appl. No.: 17/543,176

(22) Filed: Dec. 6, 2021

(65) Prior Publication Data

US 2022/0105399 A1 Apr. 7, 2022

Related U.S. Application Data

(63) Continuation of application No. 17/176,332, filed on Feb. 16, 2021, now Pat. No. 11,192,007.

(60) Provisional application No. 62/976,881, filed on Feb. 14, 2020.

(51) Int. Cl.
*A63B 55/40* (2015.01)
*A63B 71/06* (2006.01)

(52) U.S. Cl.
CPC ..... *A63B 55/40* (2015.10); *A63B 71/0669* (2013.01); *A63B 2071/0691* (2013.01); *A63B 2220/12* (2013.01); *A63B 2225/20* (2013.01)

(58) Field of Classification Search
CPC ..... A63B 55/40; A63B 71/0669; A63B 2071/0691; A63B 7/0669
USPC ..... 473/407
See application file for complete search history.

(56) References Cited

U.S. PATENT DOCUMENTS

| | | | | |
|---|---|---|---|---|
| 5,565,845 | A | 10/1996 | Hara | |
| 6,023,225 | A | 2/2000 | Boley et al. | |
| 6,525,690 | B2 | 2/2003 | Rudow et al. | |
| 6,774,792 | B1 * | 8/2004 | Williams | G08B 13/1472 206/315.6 |
| 9,248,353 | B1 | 2/2016 | Koenig et al. | |
| 10,427,016 | B1 | 10/2019 | Richmond | |
| 11,192,012 | B2 * | 12/2021 | Lupfer | A63B 60/46 |
| 2015/0126308 | A1 | 5/2015 | Penn et al. | |
| 2015/0200605 | A1 | 7/2015 | Weis et al. | |
| 2015/0370287 | A1 | 12/2015 | Ko et al. | |
| 2017/0232296 | A1 | 8/2017 | Niegowski et al. | |
| 2019/0373995 | A1 | 12/2019 | Munoz | |
| 2019/0373998 | A1 | 12/2019 | Knittel et al. | |

* cited by examiner

*Primary Examiner* — Sue A Weaver
(74) *Attorney, Agent, or Firm* — Schmeiser, Olsen & Watts LLP

(57) ABSTRACT

Provided is a smart golf bag system. The system includes a computing device coupled to a bag and a server coupled to the computing device. The system may include a sensor system coupled to the bag, wherein the sensor system communicates with the computing device. The system tracks golfer data, such as distance hit with each club used in a round of golf, the weather, time of day and the like. The data is stored and aggregated in the server and may be analyzed to suggest clubs based on the distance to the hole, etc.

5 Claims, 14 Drawing Sheets

SMART GOLF BAG SYSTEM

CROSS REFERENCE TO RELATED APPLICATION

This application is a continuation of U.S. Patent Application to Charles Isgar entitled "SMART GOLF BAG SYSTEM," Ser. No. 17/176,332, filed Feb. 16, 2021, now U.S. Pat. No. 11,192,007, issued Dec. 7, 2021, which claims priority to U.S. Provisional Patent Application entitled "SMART GOLF BAG SYSTEM," Ser. No. 62/976,881, filed Feb. 14, 2020, the disclosures of which are hereby incorporated entirely herein by reference.

BACKGROUND OF THE INVENTION

Technical Field

This invention relates generally to a golf bag and more particularly to a smart golf bag system for automatically collecting, storing and aggregating golf data including golfer data, such as golf course played, golf clubs used, distance hit with the clubs, weather and so forth.

State of the Art

A golf bag is one piece of golf equipment that travels with the golfer around a golf course. The clubs are repeatedly removed, used and replaced within the golf bag throughout a round of golf. Golfers typically have distances that they believe they hit using each of their clubs within the golf bag. However, this is based on the simple mental calculations performed by the golfer throughout the round. For example, the golfer may determine that a shot distance to the green is 150 yards and believes that he can hit his 9 iron about that distance and then proceeds to utilize that club. The distances that a ball is hit with each club have many other contributing factors that are typically not accounted for in a round of golf. There lacks a system that tracks and aggregates information regarding golf club usage, distance hit, weather conditions, golf course location, and the like, in order to use in future rounds of golf to recommend the right club for the distance to the hole.

Accordingly, there is a need for a smart golf bag system to address at least the tracking and aggregating information regarding golf club usage, distance hit, weather conditions, golf course location, and the like, for use in future rounds of golf to recommend the right club for the distance to the hole.

SUMMARY OF THE INVENTION

The present invention relates to a smart golf bag system to address at least the tracking and aggregating information regarding golf club usage, distance hit, weather conditions, golf course location, and the like, in order to use in future rounds of golf to recommend the right club for the distance to the hole.

An embodiment includes a smart golf bag system comprising: a golf bag with a sensor system coupled to the golf bag, the sensor system comprising a plurality of sensors associated with each club of a plurality of clubs within the golf bag; a computing device coupled to the sensor system of the golf bag; and a server having memory storing golfer information coupled to the computing device, wherein the computing device establishes a connection with the sensor system of the golf bag and the server in order to communicate information received from the sensor system with the server, wherein the server is programmed to: receive, from the computing device, a signal comprising the golfer information, comprising a first golf club removed from the golf bag and GPS location of the computing device, and store the first golf club removed and the GPS location of the computing device as part of the golf information; receive from the computing device, a signal indicating the first golf club was replaced within the golf bag; receive from the computing device, a signal comprising GPS location of the golf bag and store the GPS location in response to the computing device reaching the location of a golf ball hit by the first golf club; and automatically determine the distance the first golf club hit the golf ball and the distance to a golf hole from the computing device and send instructions for display on a display of the computing device comprising the distance the golf ball was hit by the first golf club and/or the distance from the golf bag to the golf hole. The server may be further programmed to automatically send for display on the display of the computing device a club recommendation for a second golf club based on the distance from the golf bag to the golf hole. The computing device may be configured to be operated by a golfer. The golf bag may comprise a plurality of club slots and wherein each of the plurality of club slots may comprise a single sensor of the plurality of sensors. Each of the plurality of clubs may be inserted in one of the plurality of club slots. The golf bag may comprise a pouch to hold the computing device. The display may comprise a screen that is malleable and that can band around a contour of the golf bag. The computing device may be programmed to transmit the GPS location to the server continuously. The computing device may be programmed to transmit the GPS location at regular intervals.

Another embodiment includes a plurality of smart golf bag systems configured to communicate with each other, each of the plurality of smart golf bag systems comprising: a golf bag with a sensor system coupled to the golf bag, the sensor system comprising a plurality of sensors associated with each club of a plurality of clubs within the golf bag; a computing device coupled to the sensor system of the golf bag; and a server having memory storing golfer information coupled to the computing device, wherein the computing device establishes a connection with the sensor system of the golf bag and the server in order to communicate information received from the sensor system with the server, wherein the server is programmed to: receive, from the computing device, a signal comprising the golfer information, comprising a first golf club removed from the golf bag and GPS location of the computing device, and store the first golf club removed and the GPS location of the computing device as part of the golf information; receive from the computing device, a signal indicating the first golf club was replaced within the golf bag; receive from the computing device, a signal comprising GPS location of the golf bag and store the GPS location in response to the computing device reaching the location of a golf ball hit by the first golf club; and automatically determine the distance the first golf club hit the golf ball and the distance to a golf hole from the computing device and send instructions for display on a display of the computing device comprising the distance the golf ball was hit by the first golf club and/or the distance from the golf bag to the golf hole. The server may be further programmed to automatically send for display on the display of the computing device a club recommendation for a second golf club based on the distance from the golf bag to the golf hole. The computing device may be configured to be operated by a golfer. The golf bag may comprise a plurality of club slots and wherein each of the plurality of club slots may comprise a single sensor of the plurality of sensors. Each of the plurality of clubs may be inserted in one of the plurality of club slots. The golf bag may comprise a pouch to hold the computing device. The display may comprise a screen that is malleable and that can band around a contour of the golf bag. The computing device may be programmed to transmit the GPS location to the server continuously. The computing device may be programmed to transmit the GPS location at regular intervals.

The foregoing and other features and advantages of the present invention will be apparent from the following more detailed description of the particular embodiments of the invention, as illustrated in the accompanying drawings.

BRIEF DESCRIPTION OF THE DRAWINGS

A more complete understanding of the present invention may be derived by referring to the detailed description and claims when considered in connection with the Figures, wherein like reference numbers refer to similar items throughout the Figures, and:

DETAILED DESCRIPTION OF EMBODIMENTS OF THE INVENTION

Figure 1:
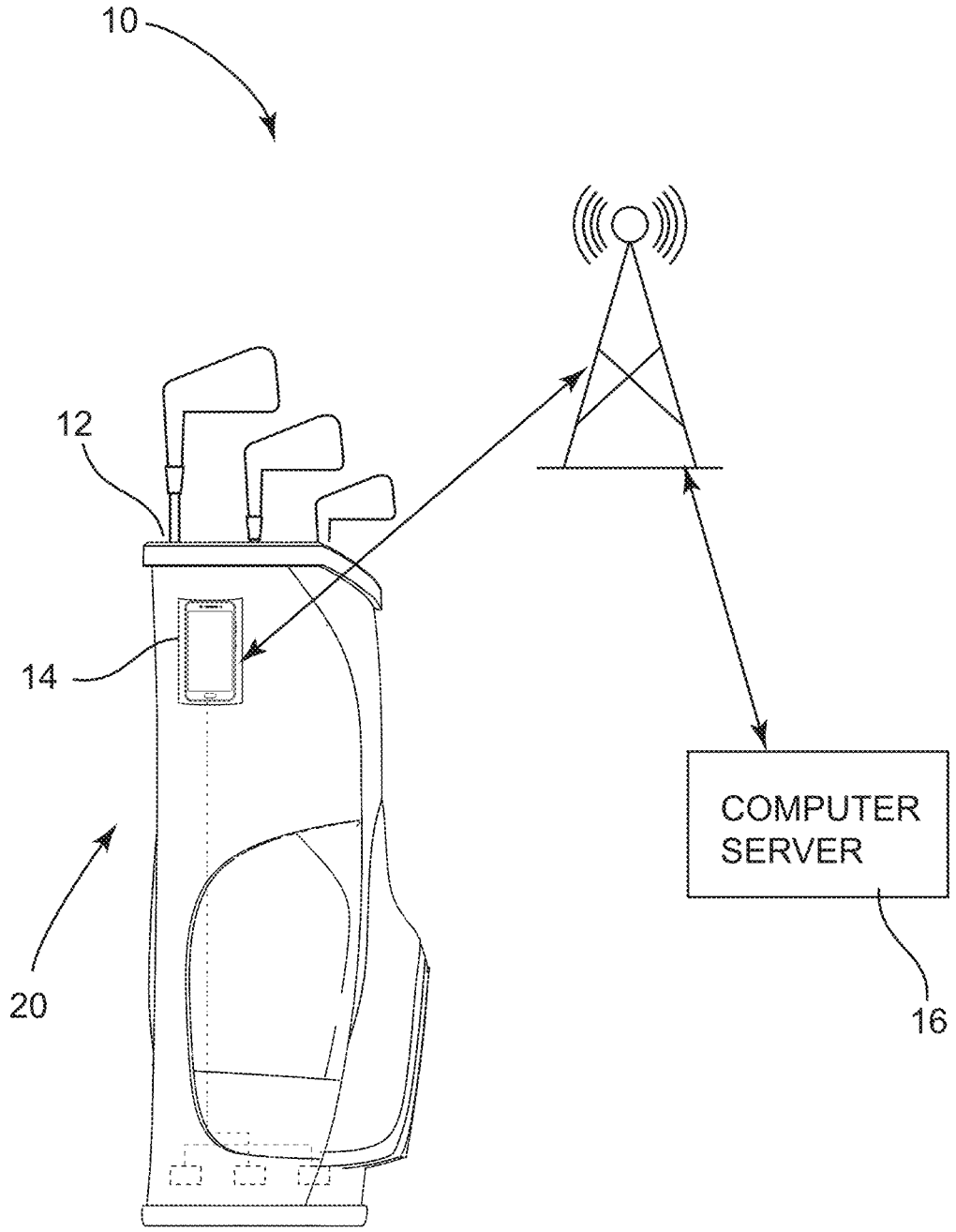
FIG. 1 is a diagrammatic view of a smart golf bag system in accordance with a first embodiment.

As discussed above, embodiments of the present invention relate to a smart golf bag system to address at least the tracking and aggregating information regarding golf club usage, distance hit, weather conditions, golf course location, and the like, for use in future rounds of golf to recommend the right club for the distance to the hole.

A first embodiment is depicted in FIGS. 1-5. The first embodiment may include a smart golf bag system 10 comprising a golf bag 12 with a sensor system 20, a computing device 14 coupled to the sensor system 20 and a server 16 coupled to the computing device 14. The coupling between the sensor system 20 and the computing device 14 may be coupled with a wire connection, wherein the wire connection supplies power to the sensors. Further, in some embodiments, the coupling between the sensor system 20 and the computing device 14 may be a wireless connection. The coupling between the computing device 14 and the server 16 may be network connections, such as through an Internet connection, a 5G connection or the like, wherein the computing devices 14 may communicate with and receive communication from the server 16. In embodiments, the computing device 14 may be, without limitation, a smartphone, a tablet, a computer or the like. The server may include a memory that stores golfer information, such as a username and prior rounds of golf including distances hit for each club used in the rounds of golf, the location, the weather, the time of day and the like.

Figure 2:
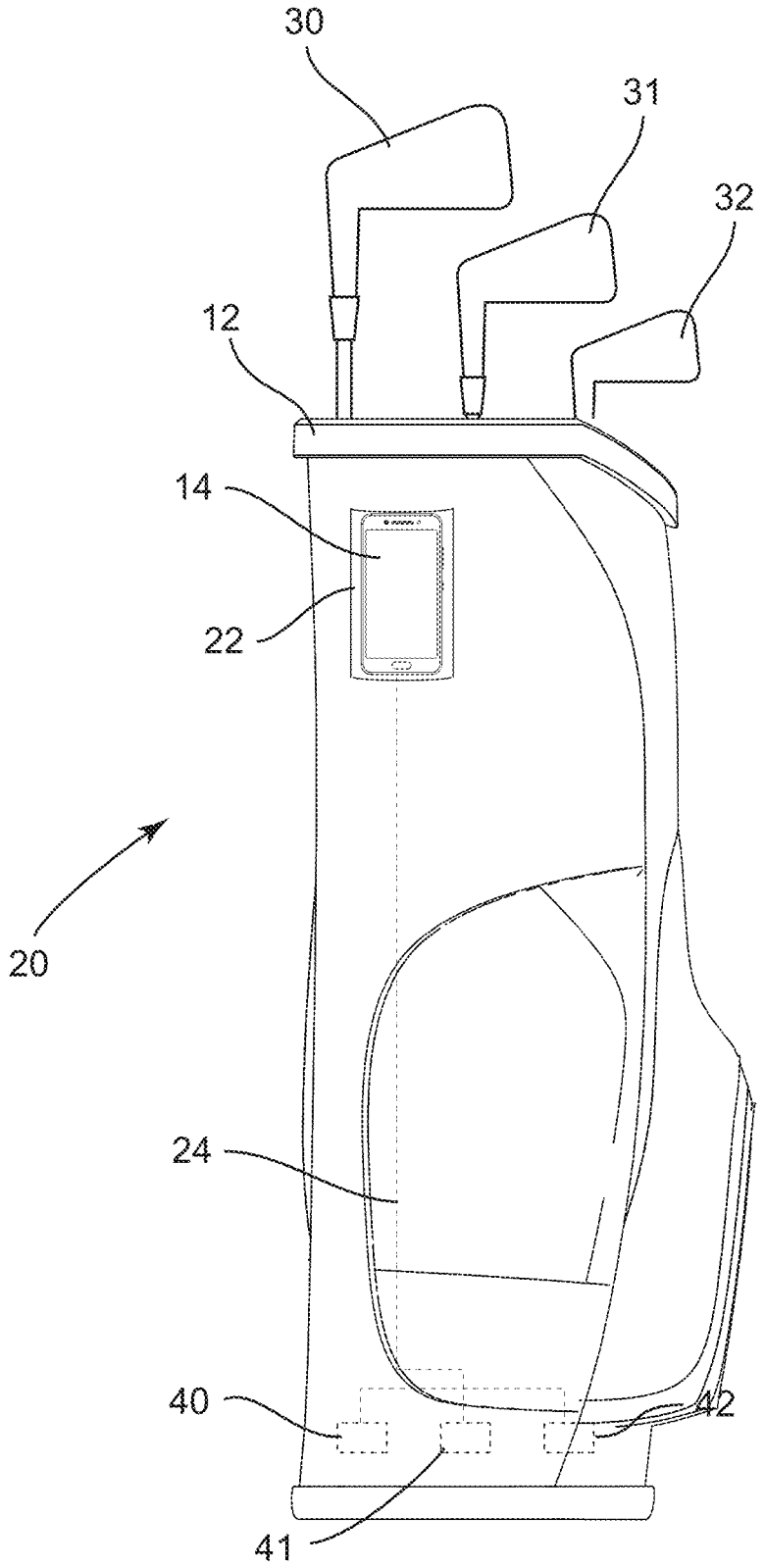
FIG. 2 is a side view of golf bag with a computing device coupled thereto in accordance with the first embodiment.
Figure 3:
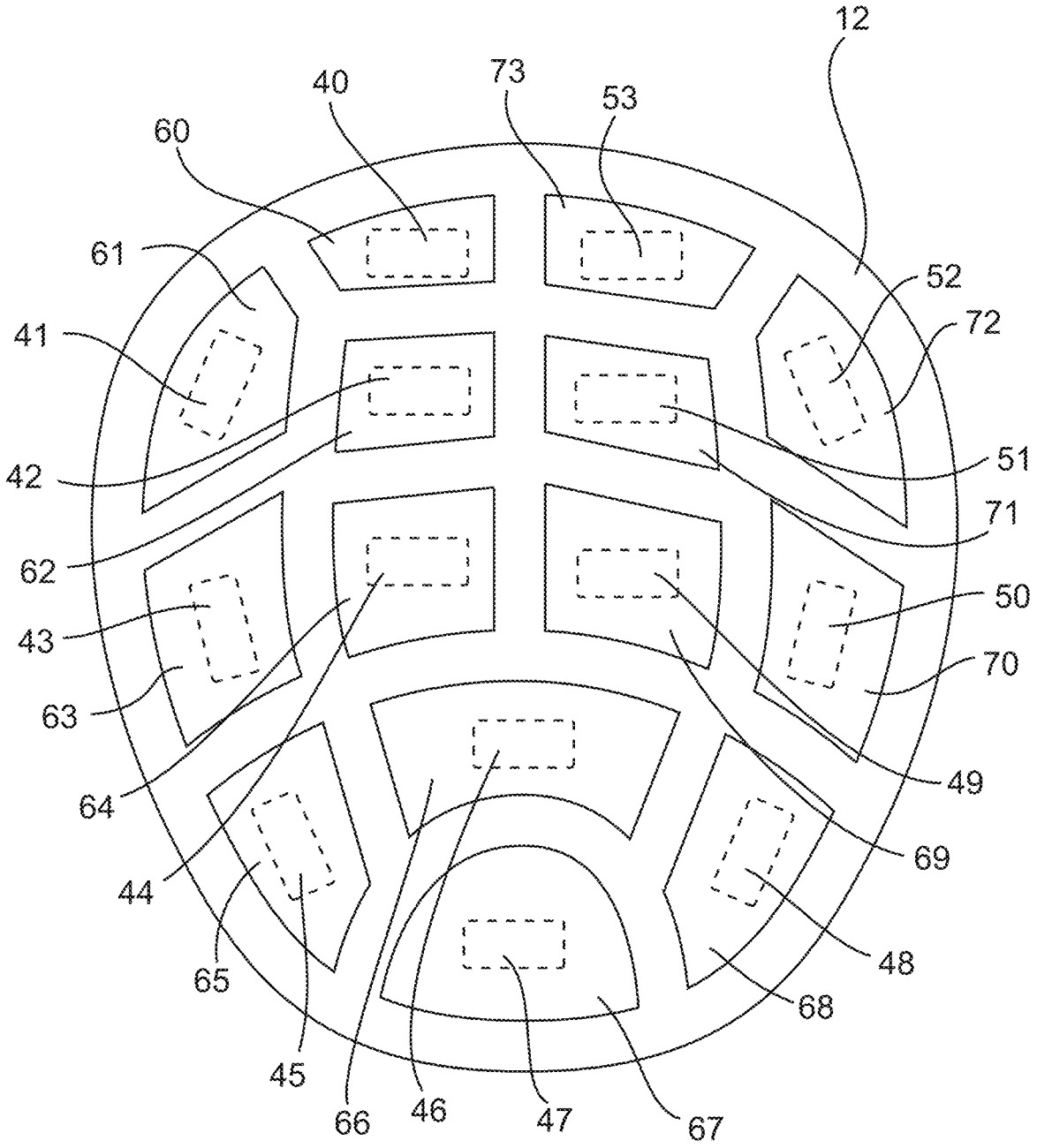
FIG. 3 is a top view of a golf bag in accordance with the first embodiment.

In operation, the golf bag 12 may include a pouch 22 or the like to hold the computing device 14, wherein the computing device 14 may be slid in and out of the pouch 22. The sensor system 20 may include sensors 40-53. In FIG. 2, sensors 40-42 are depicted and they are coupled to the computing device 14 through connection 24. In embodiments, connection 24 is a wired connection that is coupled the computing device 14, wherein connection 24 operates to supply power to the sensors from the computing device 14 and further provides communication from the sensors 40-53 to the computing device 14. Referring further to FIG. 3, the golf bag 12 may include sensors 40-53 that correspond to club slots 60-73 respectively, wherein each slot 60-73 includes a single sensor 40-53. This allows for a sensor 40-53 to be associated with each club inserted within the club slots 60-73.

Figure 4:
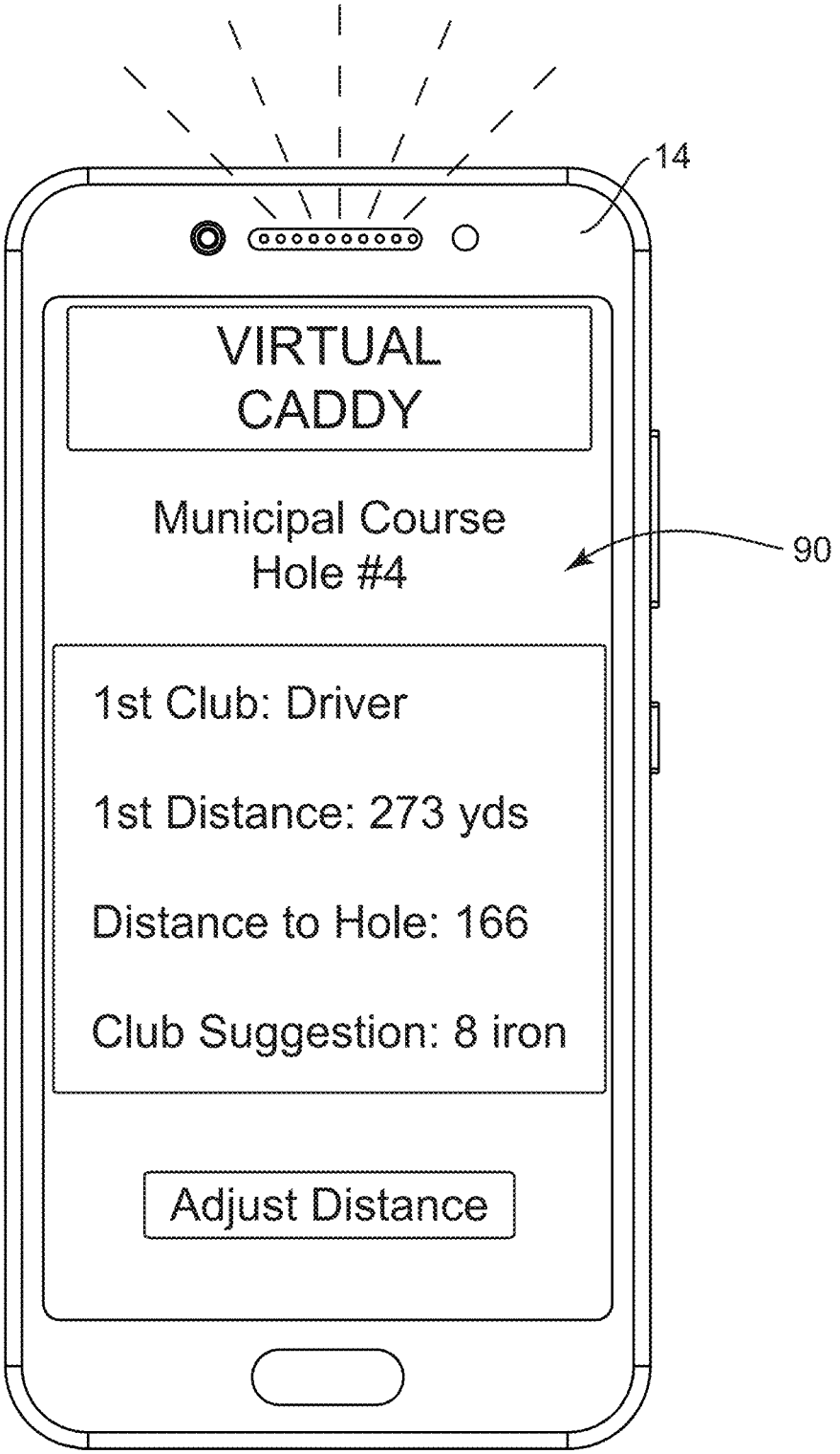
FIG. 4 is a view of computing device operating a smart golf bag app in accordance with the first embodiment.
Figure 5:
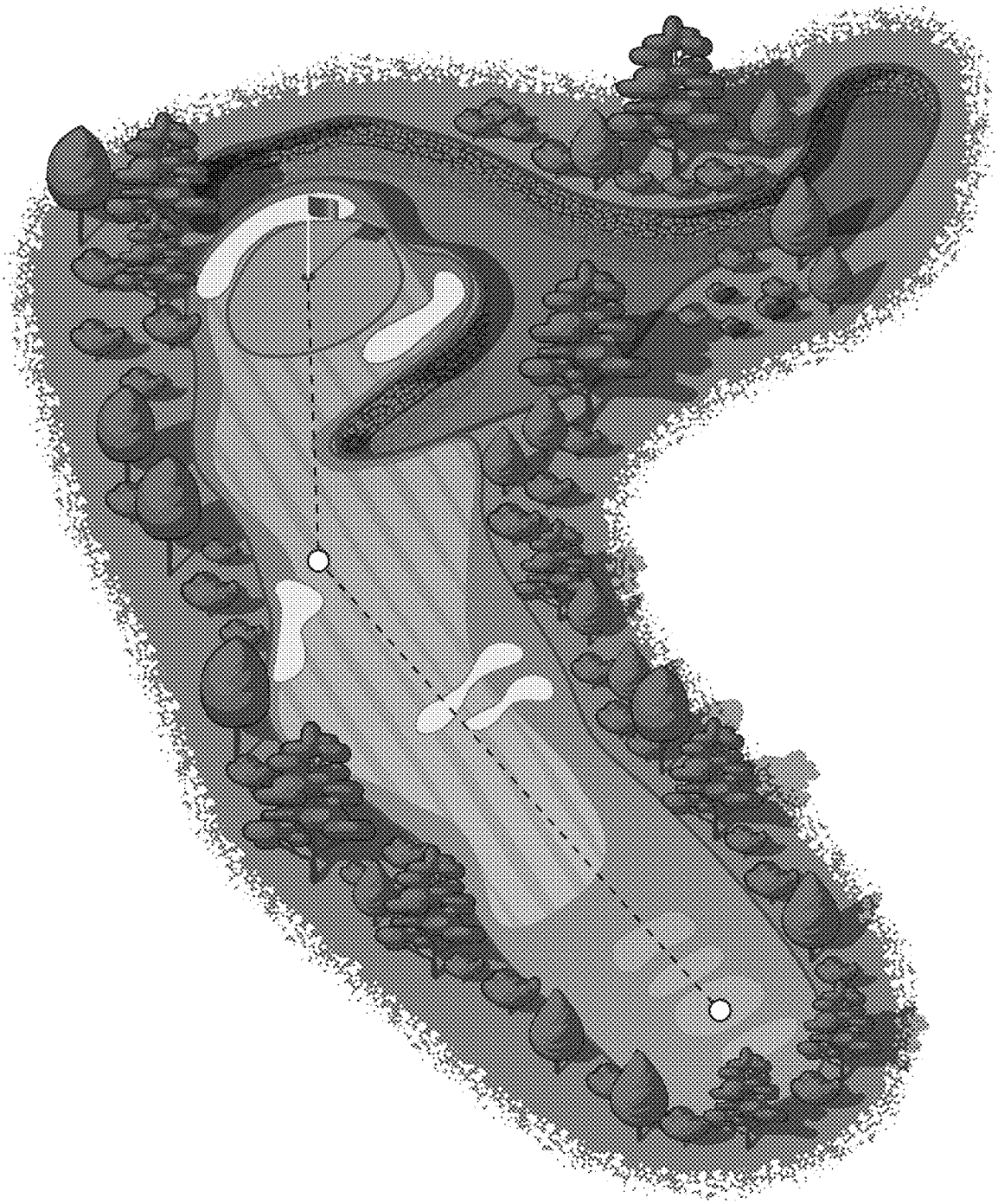
FIG. 5 is a top view of a golf hole depicting distance in accordance with the first embodiment.

The computing device 14 may operate a golf bag system application as depicted in FIG. 4. The operation of the application couples the computing device 14 to the server 16. The server 16 may be programmed to receive from the computing device 14 a signal including a first club selected in response to one of the sensors 40-53 associated with the first club communicating to the computing device 14 that the first club was removed from the bag 12 and the location of the computing device 14 at the time the club was removed from the bag 12. The server 16 may store this information in a memory of the server 16 associated with the golfer information. The golfer may then replace the club within the bag 12, generating a signal to the computing device 14 that the club has been returned. The golfer may then travel with his bag 12 to the position of the golf ball after hitting the golf ball with the first club. The server 16 may be programmed to send to the computing device 14 operating the app for display on the display/screen 90 of the computing device 14, golf data including, without limitation, a club type of the first club, a first distance of the ball hit by the first club, a distance to the hole, and a suggested club in response to receiving current location data from the computing device 14. In some embodiments, the computing device 14 may be programmed through the app to transmit location data to the server continuously, or at regular intervals, such as every 30 seconds. The server 16 calculates the data based on the location of the computing device 14 and provides a recommendation on a second club to use by processing distances hit by golf clubs in previous rounds stored in the golfer data on the server 16. FIG. 5 is a visual depiction of this system. This allows for a more accurate club suggestion, wherein the system 10 operates as a virtual caddy to support the golfer during a round of golf.

Embodiments of the system 10 operate to store aggregate data over time as a golfer continues to use the system. The server 16 may include machine learning programming, wherein the server 16 operates to consider multiple factors and changing factors over time to better predict the club to use, given a plurality of variables, such as, but not limited to, location, elevation, weather, time of year, time of day, recent historical trends in club distance and the like.

Figure 6:
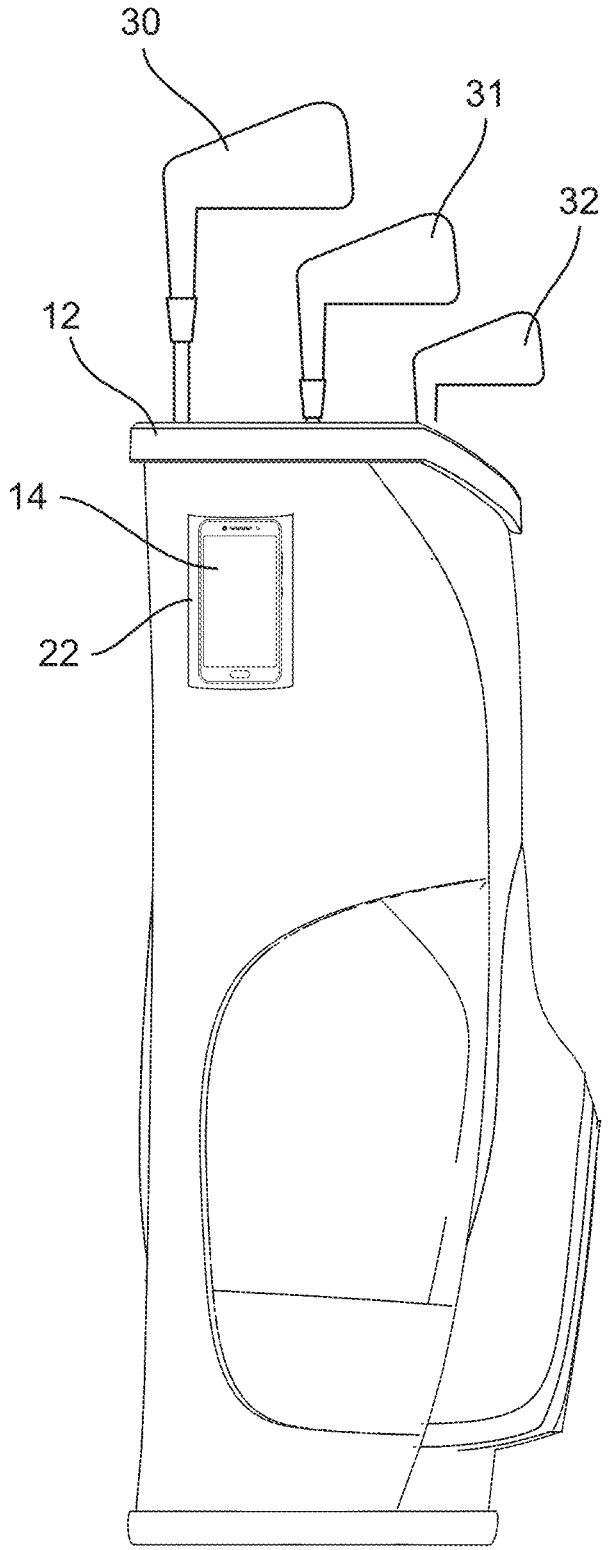
FIG. 6 is a view of a computing device operating as a part of a manual smart golf bag system showing a computing device coupled to a golf bag in accordance with a second embodiment.

A second embodiment is depicted in FIGS. 6-9. The second embodiment, as shown in FIG. 6, may include a smart golf bag system 10 comprising a golf bag 12, one or more golf clubs 30, 31 and 32 and a computing device 14 coupled to a server 16. The coupling between the computing device 14 and the server 16 may be network connections, such as through an Internet connection, a 5G connection or the like, wherein the computing devices 14 may communicate with and receive communication from the server 16. In embodiments, the computing device 14 may be, without limitation, a smartphone, a tablet, a computer or the like. The server may include a memory that stores golfer information, such as a username and prior rounds of golf including distances hit for each club used in the rounds of golf, the location, the weather, the time of day and the like.

Figure 7:
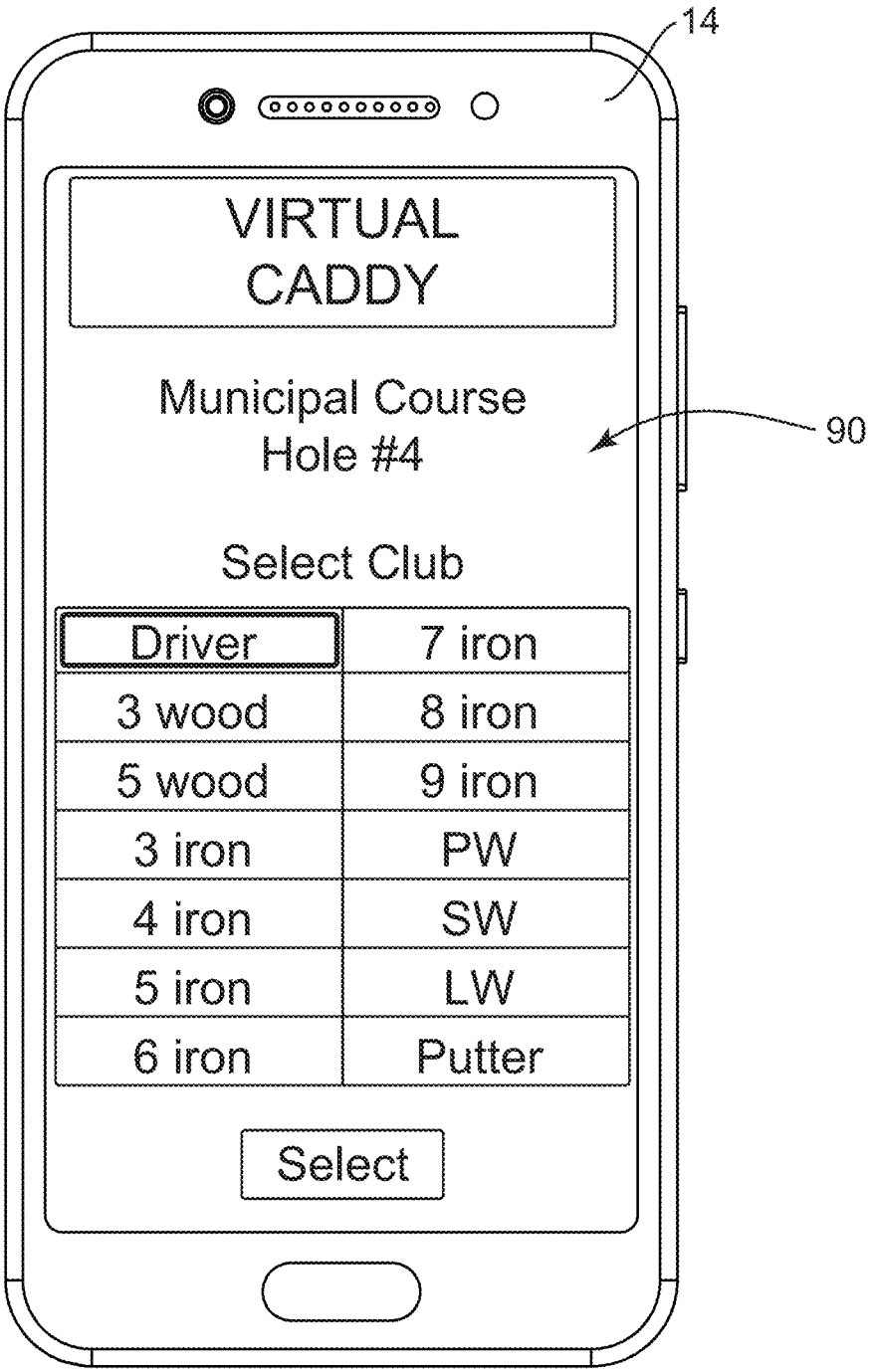
FIG. 7 is a view of a computing device operating as a part of a manual smart golf bag system showing selection of a first golf club in accordance with a second embodiment.
Figure 8:
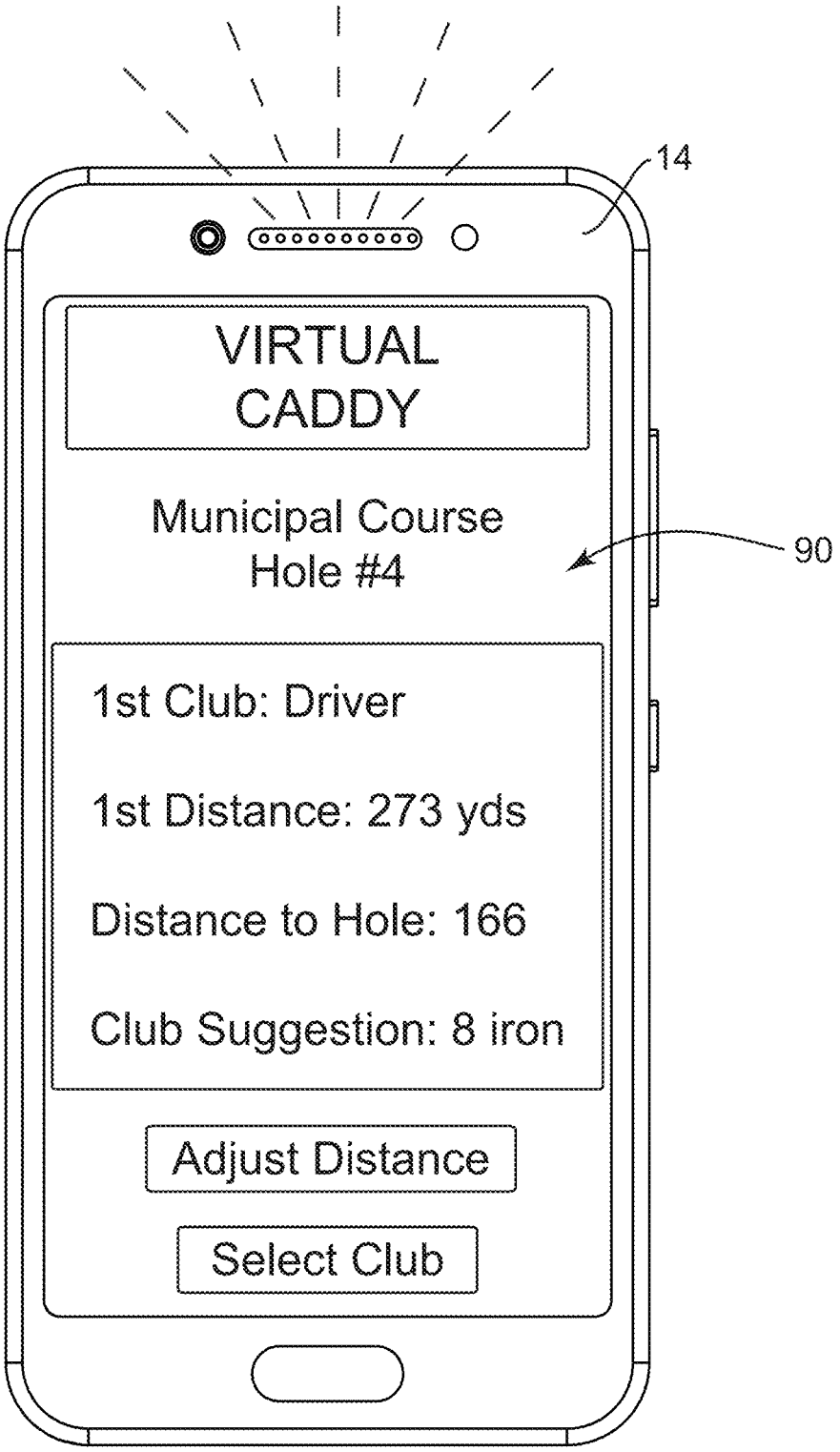
FIG. 8 is a view of the computing device operating as a part of a manual smart golf bag system showing distance and a suggested golf club for a next hit in accordance with the second embodiment.
Figure 9:
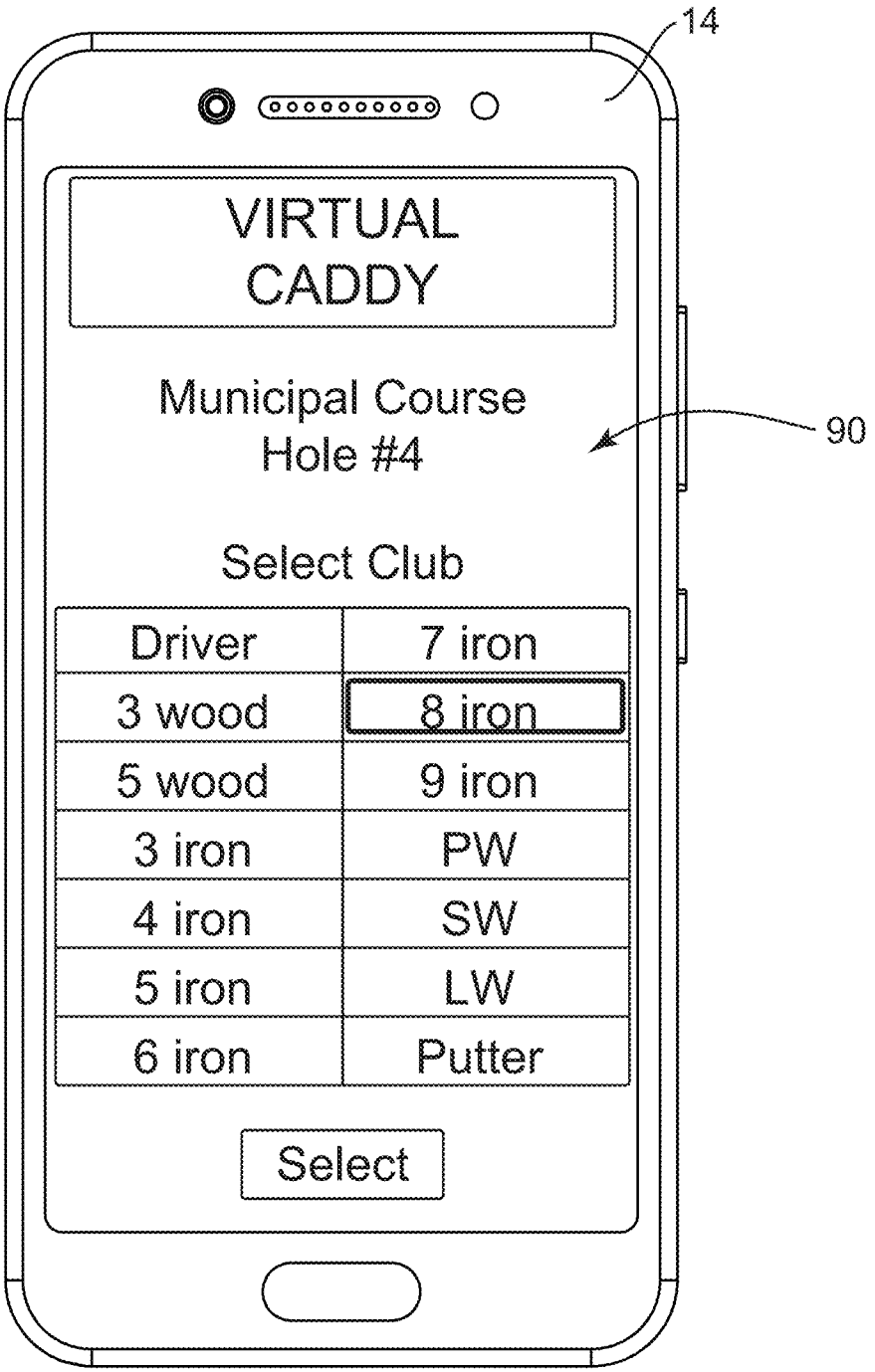
FIG. 9 is a view of the computing device operating as a part of a manual smart golf bag system showing selection of a second golf club in accordance with the second embodiment.

In operation, the golf bag 12 may include a pouch 22 or the like to hold the computing device 14, wherein the computing device 14 may be slid in and out of the pouch 22. The computing device 14 may operate a golf bag system application as depicted in FIGS. 7-9. The operation of the application couples the computing device 14 to the server 16. The server 16 may be programmed to receive from the computing device 14 a signal including a first club selected by a golfer selecting a button associated with the first club and the location of the computing device 14 at the time the club was selected using the computing device 14, as shown in FIG. 7. The server 16 may store this information in a memory of the server 16 associated with the golfer information. The golfer may then travel with his bag 12 to the position of the golf ball after hitting the golf ball with the first club. The server 16 may be programmed to send to the computing device 14 operating the app for display on the screen of the computing device 14, golf data including, without limitation, a club type of the first club, a first distance of the ball hit by the first club, a distance to the hole, and a suggested club in response to receiving current location data from the computing device 14. In some embodiments, as shown in FIG. 8, the computing device 14 may be programmed through the app to transmit location data to the server continuously, or at regular intervals, such as every 30 seconds. The server 16 calculates the data based on the location of the computing device 14 and provides a recommendation on a second club to use by processing distances hit by golf clubs in previous rounds stored in the golfer data on the server 16. FIG. 5 is a visual depiction of this system. This allows for a more accurate club suggestion, wherein the system 10 operates as a virtual caddy to support the golfer during a round of golf. As shown in FIG. 8, the golfer may select to adjust the distance the ball was hit. Further, the golfer may push the select club button and directed to the interface as depicted in FIG. 9. The golfer may then select a second club as the system operates as described above with regard to the first club selection.

The system 10 may also operate to allow voice interaction with the system 10. The golfer may vocalize all interactions with the system in order for the system 10 to operate as described above.

Figure 10:
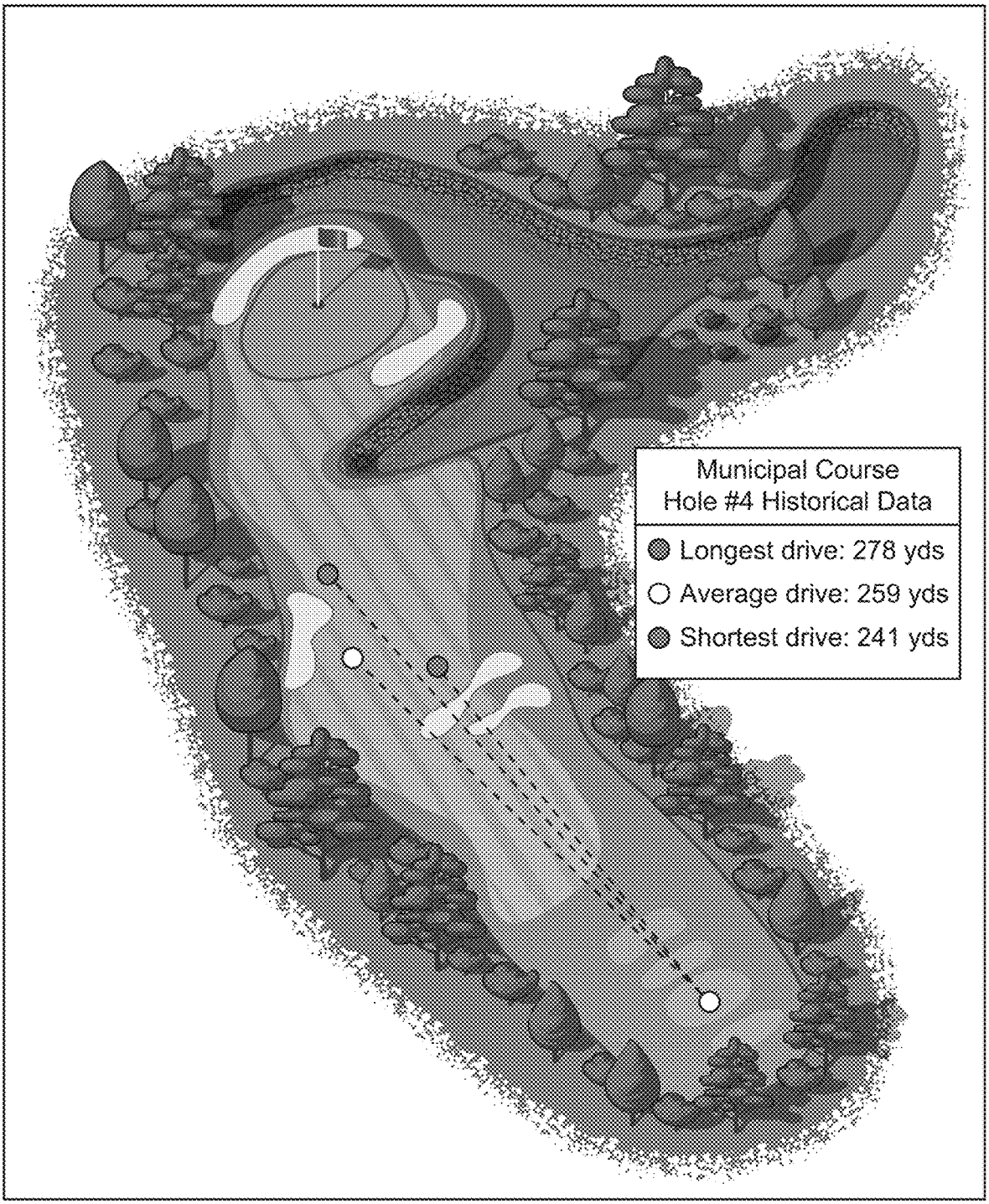
FIG. 10 is a top view of a golf hole depicting historical distance data in accordance with the first embodiment.

Embodiments of the system 10 operate to store aggregate data over time as a golfer continues to use the system. The server 16 may include machine learning programming, wherein the server 16 operates to consider multiple factors and changing factors over time to better predict the club to use given a plurality of variables, such as, but not limited to, location, elevation, weather, time of year, time of day, recent historical trends in club distance and the like. This data may be sent to the computing device for use by the golfer, such as that depicted in FIG. 10 wherein one example of such data is depicted that includes historical distance the golfer has hit the ball off of the tee on a particular hole of a particular course.

Figure 11:
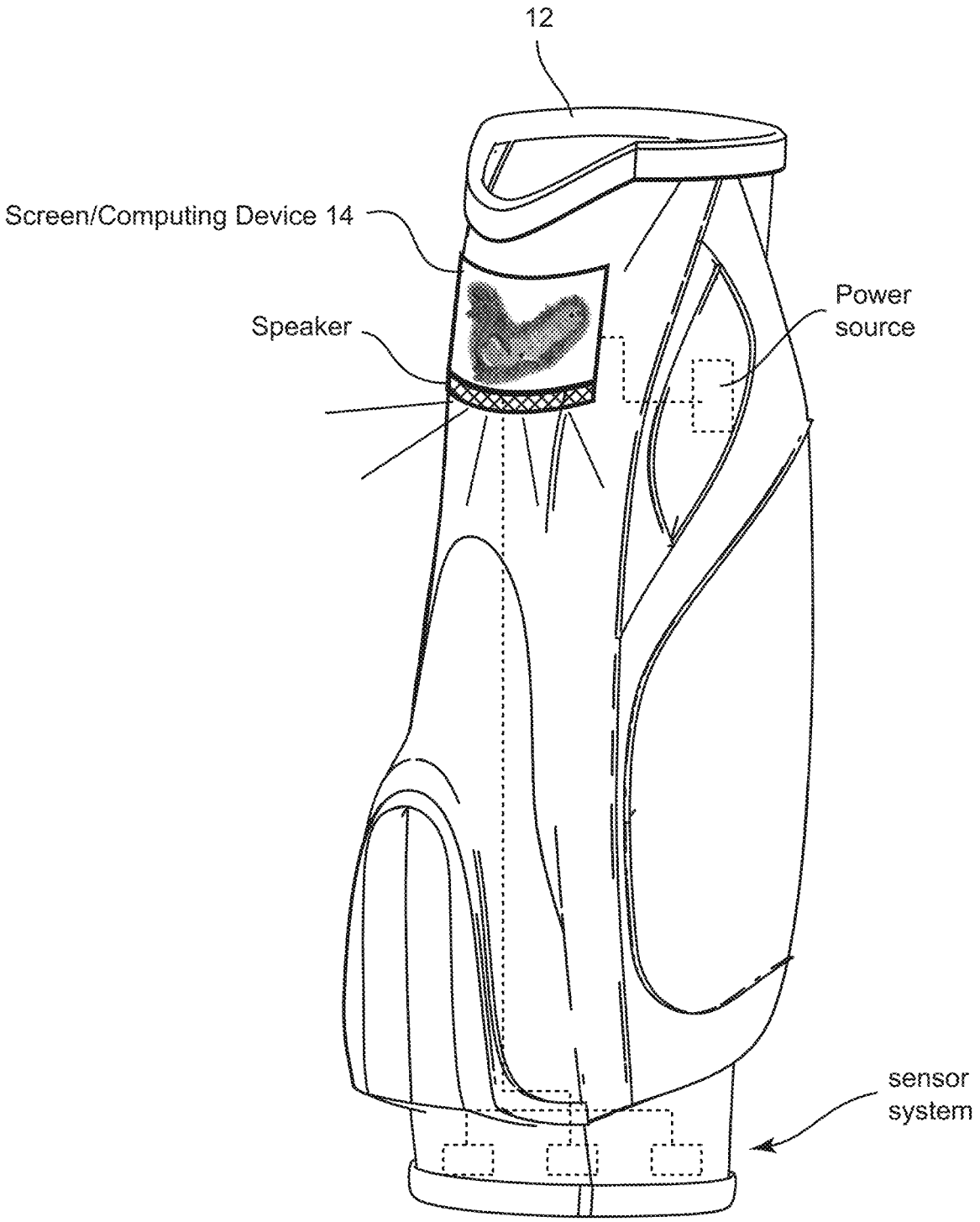
FIG. 11 is a side view of golf bag with a computing device coupled thereto in accordance with the third embodiment.

In a third embodiment, as shown in FIG. 11, the computing device 14 may be fixedly coupled to the golf bag 12, wherein there is power supplied to the computing device and sensors if any. The system 10 in this third embodiment operates in a manner similar to the first or second embodiment described above. Further, the system may be used to power other devices, such as, but not limited to, powering a mobile phone, powering speakers and the like. The computing device 14 may include a screen that is malleable and that can band around the contour of the bag. In some embodiments, the computing device 14 is a mobile computing device that is connected to the screen and the screen operates as a display and input device for the mobile computing device. The screen may have touch sensitivity in order to receive input from the user. As described above, the system may operate as a voice recognition and voice interaction system. The speaker shown in FIG. 11 may provide audio from the device to the golfer and the system may include a microphone to receive voice input from the golfer. The speaker may provide additional functionality, such as playing music, and the like, from a connected phone or other type of device.

Figure 12:
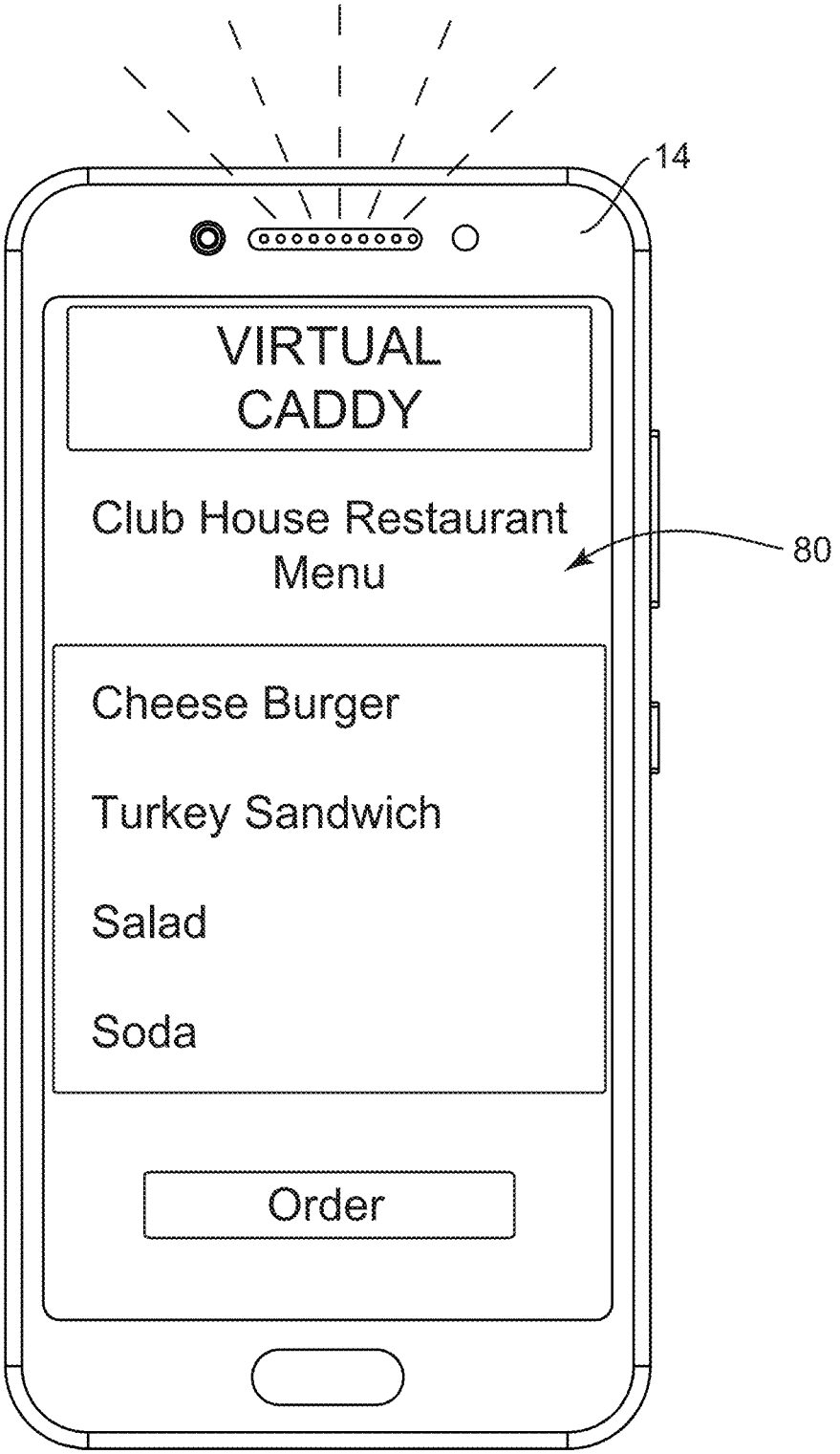
FIG. 12 is a view of the computing device operating to order a meal during a round of golf from a golf course restaurant in accordance with the second embodiment.

The system 10 may also be used, as shown in FIG. 12, to order food from a restaurant of the golf course. The server 16 may be programmed to send food service information to the computing device 14 operating the app for display on the display/screen 80 of the computing device 14, This may be done at a predetermined hole in order for the food to be ready when the round of golf is complete.

Figure 13:
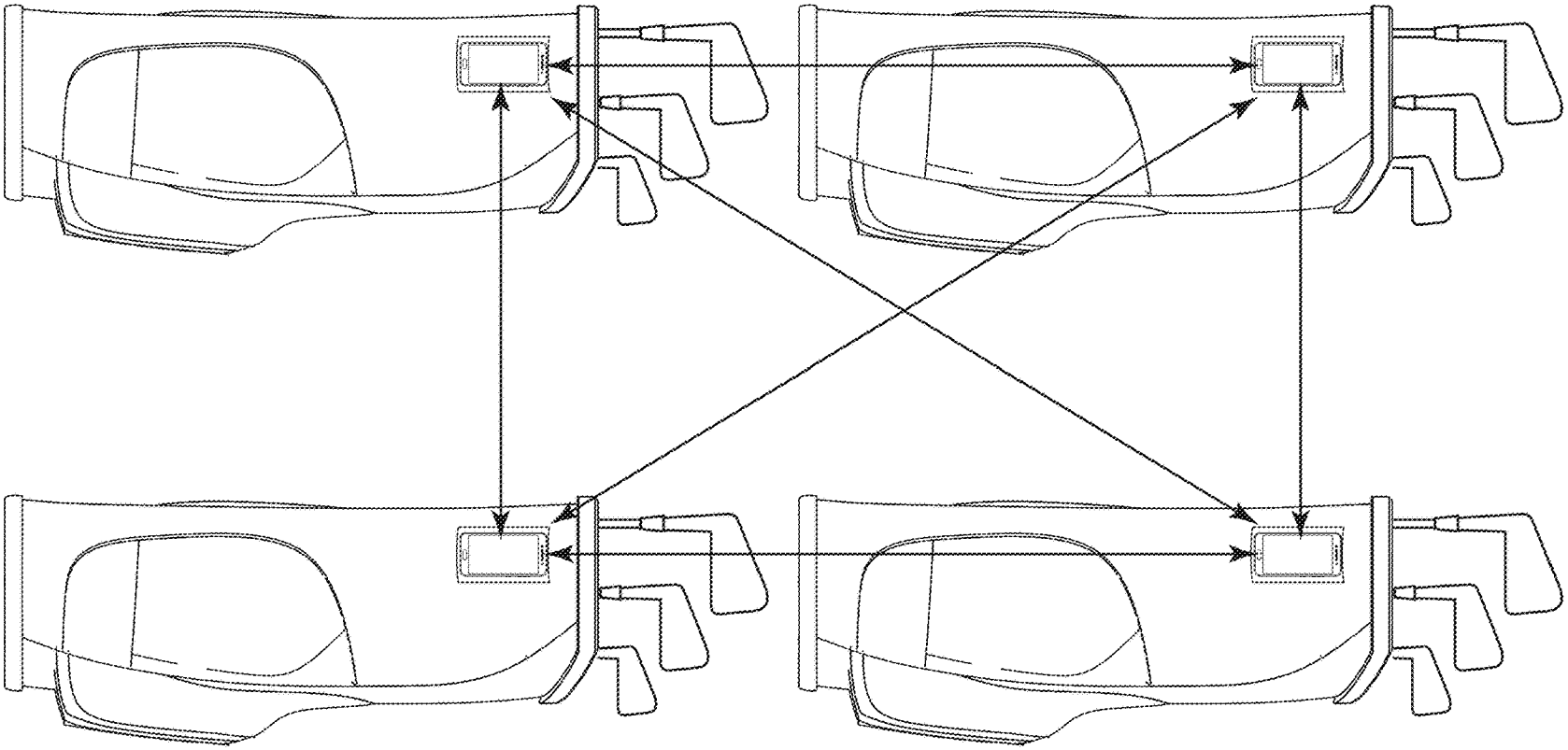
FIG. 13 is a view of a plurality of smart bag systems operating in communication with each other in accordance with the second embodiment.

Referring again to FIG. 13, the system 10 may include the ability for a plurality of smart golf bag systems 10 to communicate with each other. This connection may be utilized for the system 10 to automatically pair golfers based on certain data of each golfer, such as handicap or the like. The system may also allow golfers to share data with each other such as score and historical data if desired. Additionally, in embodiments, one of the smart golf bag systems 10 may be coupled to the server 16 and the remainder of systems in the group may be coupled to the server 16 through the one system that is coupled to the server 16, wherein that one system operates as a connection hub for the remainder systems in the group. This allows all data from all systems to be sent to and stored in the server 16 and to communicate to each system through the system acting as hub.

In operation, the system 10 collects data, such as score, weather, instant weather and the like. The system may automatically determine trends in the golfer's historical distance, including weather implications on the historical trends. The system may also allow for notifications to be sent to a golfer, such as pace of play notifications. The system may also allow a golfer to edit data to be recorded, such as a shanked shot, wherein the golfer re-hits the shot (a mulligan).

Figure 14:
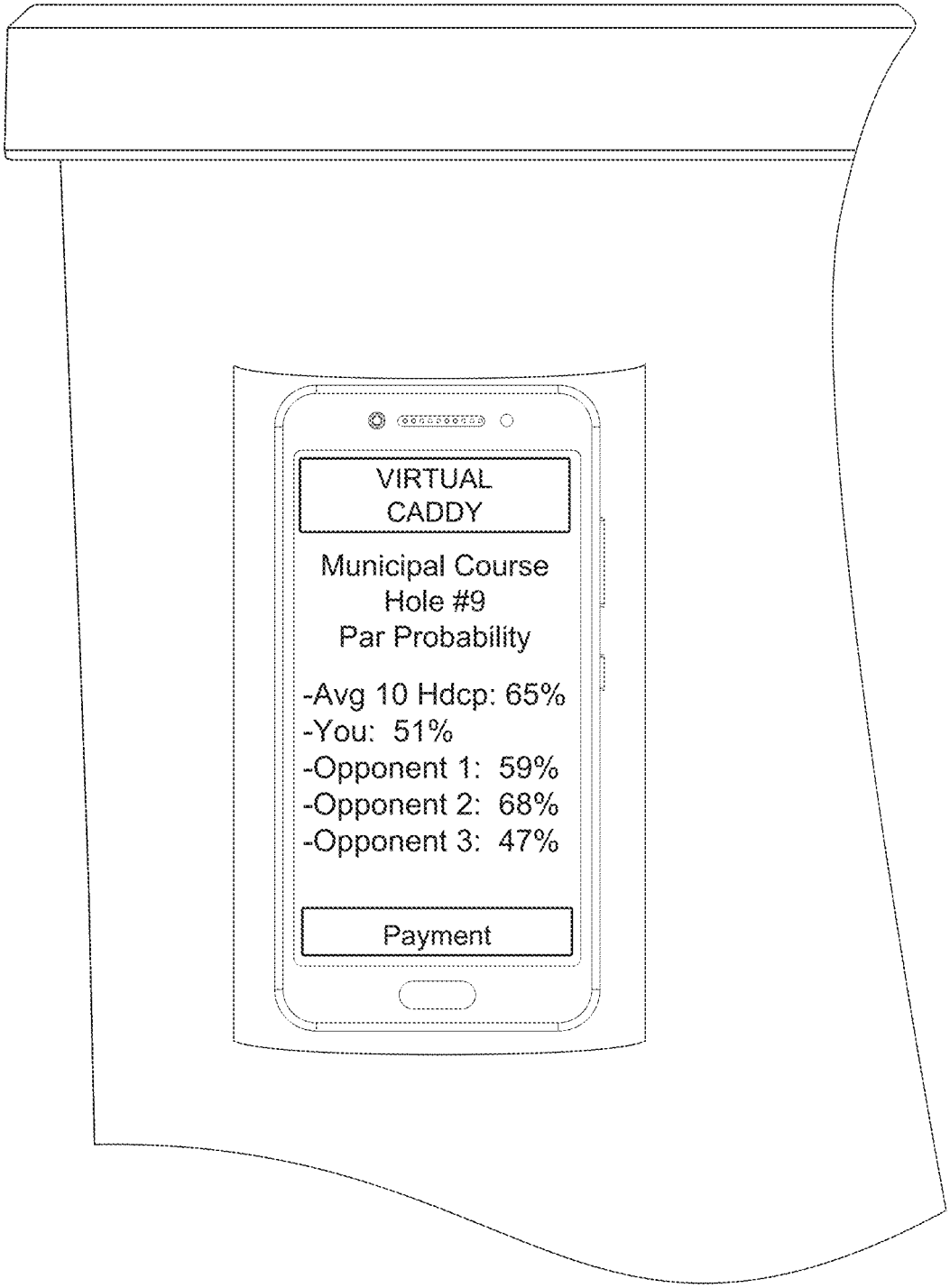
FIG. 14 is a view of the computing device operating to depict probabilities of par on a hole for a group playing together in accordance with the second embodiment.

In some embodiments, as depicted in FIG. 14, server 16 may be programmed to generate and deliver for display on the computing device 14 probabilities of making a certain score, such as, but not limited to par, on a particular hole. For example and without limitation, the server may generate the probability that a golfer with a similar handicap would make par on the hole, what the golfer's probability is based on the data stored in the server for that golfer, and then probabilities for other golfers or opponents in a group. This can be utilized in certain entertainment games or group competitions. In such embodiments, this data and other similar type data can give real-time odds based on the historical data for each participant and provide additional entertainment in the use of such data for group competition and entertainment games. In at least this way, big data analysis can automatically be performed by the server to make predictions of game play by a user/golfer of the system and can be done in comparison with other users/golfers. Some such entertainment or competition may include a payment component for play, and the system 10 may provide seamless connectivity to a payment system that can transfer funds from one user/golfer to another.

The embodiments and examples set forth herein were presented in order to best explain the present invention and its practical application and to thereby enable those of ordinary skill in the art to make and use the invention. However, those of ordinary skill in the art will recognize that the foregoing description and examples have been presented for the purposes of illustration and example only. The description as set forth is not intended to be exhaustive or to limit the invention to the precise form disclosed. Many modifications and variations are possible in light of the teachings above without departing from the spirit and scope of the forthcoming claims.

The invention claimed is:

1. A smart golf bag system comprising:

a golf bag comprising a plurality of club slots with a sensor system coupled to the golf bag, the sensor system comprising a plurality of sensors associated with each club of a plurality of clubs within the golf bag;

a computing device coupled to the sensor system of the golf bag; and a server having memory storing golfer information coupled to the computing device, wherein the computing device establishes a connection with the sensor system of the golf bag and the server in order to communicate information received from the sensor system with the server, wherein the server is programmed to:

receive, from the computing device, a signal comprising weather information, and the golfer information comprising a first golf club removed from the golf bag and first GPS location of the computing device, and store the weather information, the first golf club removed and the first GPS location of the computing device as part of the golf information in response to the computing device automatically receiving a signal from the sensor associated with the first golf club;

receive from the computing device, a signal automatically sent from the computing device indicating the first golf club was replaced within the golf bag in response to the computing device automatically receiving a signal from the sensor associated with the first golf club;

receive from the computing device, a signal comprising a second GPS location of the golf bag and store the second GPS location in response to the computing device reaching the location of a golf ball hit by the first golf club and removing a second golf club;

automatically determine a distance between the first GPS location and second GPS location store the distance with the golf information associated with the first golf club;

continue collect and gather golf information for each shot during a round of golf and aggregate the data for the golfer on the server; and automatically send for display on the display of the computing device a club recommendation for a second golf club based on the distance from the user computing device to the golf hole, weather and recent historical trends in club distance.

2. The smart golf bag system of claim 1, wherein the computing device is configured to be operated by a golfer.

3. The smart golf bag system of claim 1, wherein the golf bag comprises a pouch to hold the computing device.

4. The smart golf bag system of claim 1, wherein the computing device is programmed to transmit the GPS location to the server continuously.

5. The smart golf bag system of claim 1, wherein the computing device is programmed to transmit the GPS location at regular intervals.

* * * * *